United States Patent [19]

Nakamoto et al.

[11] Patent Number: 4,909,728

[45] Date of Patent: Mar. 20, 1990

[54] COMBUSTION APPARATUS

[75] Inventors: Mitsuyoshi Nakamoto; Kenji Okamoto, both of Nara; Tatsuo Fujita, Hirakata; Sachio Nagamitsu, Kyoto, all of Japan

[73] Assignee: Matsushita Electric Industrial Co., Ltd., Osaka, Japan

[21] Appl. No.: 230,697

[22] Filed: Aug. 9, 1988

Related U.S. Application Data

[63] Continuation of Ser. No. 99,905, Sep. 22, 1987, abandoned.

[30] Foreign Application Priority Data

| | | | |
|---|---|---|---|
| Sep. 26, 1986 | [JP] | Japan | 61-229003 |
| Nov. 17, 1986 | [JP] | Japan | 61-273312 |
| Jan. 29, 1987 | [JP] | Japan | 62-19212 |
| Jan. 29, 1987 | [JP] | Japan | 62-19213 |
| Apr. 17, 1987 | [JP] | Japan | 62-95634 |

[51] Int. Cl.[4] ..... F23C 5/28

[52] U.S. Cl. ..... 431/176; 431/178; 431/179; 431/207; 431/243; 431/11; 432/146

[58] Field of Search ..... 431/11, 207, 243, 350, 431/353, 175, 176, 177, 178, 179, 180, 331; 432/136, 159, 146, 147, 222, 149

[56] References Cited

U.S. PATENT DOCUMENTS

| | | | |
|---|---|---|---|
| 1,045,466 | 11/1912 | Van Zandt | 431/350 X |
| 1,141,096 | 6/1915 | Allen | 431/350 |
| 1,249,366 | 12/1917 | Fisher | 431/350 X |
| 1,827,338 | 10/1931 | Shippee | 431/176 |
| 1,894,249 | 1/1933 | Williams | 431/176 |
| 1,964,872 | 7/1934 | Dodge | 431/180 |
| 2,043,867 | 6/1936 | Rava | 431/350 X |
| 2,215,079 | 9/1940 | Hess | 431/179 X |
| 2,220,387 | 11/1940 | Baker | 431/175 X |
| 2,268,603 | 1/1942 | Linder | 431/176 X |
| 2,598,840 | 6/1952 | Schutte | 431/179 X |
| 2,933,425 | 4/1960 | Hess | 432/146 X |
| 3,551,085 | 12/1970 | Desty et al. | 431/243 |
| 3,981,675 | 9/1976 | Sztela | 431/175 |
| 4,493,638 | 1/1985 | Scammell | 431/350 X |

FOREIGN PATENT DOCUMENTS

| | | | |
|---|---|---|---|
| 0976217 | 11/1982 | U.S.S.R. | 431/176 |

*Primary Examiner*—Carl D. Price

*Attorney, Agent, or Firm*—Wenderoth, Lind & Ponack

[57] ABSTRACT

A burner includes a number of flame ports each having a fuel supply passage and provided on a pair of opposite walls of a combustion chamber such that each of the walls and the fuel supply passages define a cooling passage. In the burner, a wide stable flame region is achieved at a high excess air ratio, the amount of NOx produced is reduced and backfire is prevented by cooling the fuel supply passages. Furthermore, a flame area per unit area of each flame port is increased such that the burner can effect high-load combustion.

5 Claims, 6 Drawing Sheets

COMBUSTION APPARATUS

This is a continuation of now abandoned application Ser. No. 099,905, filed 9/22/87.

BACKGROUND OF THE INVENTION

The present invention generally relates to a combustion apparatus for burning fuel at a high excess air ratio and more particularly, to a burner for reducing the production of nitrogen oxides (hereinbelow, referred to as "NOx") in exhaust gas and enlarging the stable flame region, which is used for high-load combustion.

Problems of air pollution due to exhaust gas produced by combustion have been studied. As effective countermeasures against the problems, multistage combustion, gas mixing combustion, dividual combustion, etc. have been employed but NOx under about 50 ppm in exhaust gas cannot be achieved by these known combustion methods. A burner for domestic use has been proposed in which NOx of 10 ppm or so in exhaust gas can be achieved by employing premixed combustion. However, the prior art burner based on premixed combustion has disadvantages relating to its practical use because of its small variable ranges with respect to combustion achieved and air capacity because the stable flame region therein is narrow and that because if the excess air ratio is increased and reduced for changing the air quantity during the adjustment of the caloric, the flame is readily blown off and backfire takes place, respectively.

Meanwhile, in the combustion methods other than the premixed combustion method, it is extremely difficult to restrict NOx in exhaust gas to 10 ppm or so at the present time. Therefore, in order to restrict NOx in exhaust gas to 10 ppm or so, it is necesaary to enlarge the stable flame region in premixed combustion.

SUMMARY OF THE INVENTION

Accordingly, an essential object of the present invention is to provide a burner capable of effecting high-load combustion, in which the amount of NOx in exhaust gas is small and which has wide variable ranges with respect to the amount of combustion facilitated and air capacity, resulting substantial elimination of the disadvantages inherent in conventional burners of this kind.

In the burner of the present invention, a combustion chamber is formed by a pair of opposite walls of the combustion chamber and outlets of the combustion chamber. Meanwhile, a number of flame ports disposed at outlets of fuel supply passages are provided on the opposite walls of the combustion chamber. The fuel supply passages are provided outside the combustion chamber and a plurality of the flame ports are arranged adjacent outlets of the combustion chamber. The walls of the combustion chamber and the fuel supply passages define a passage for cooling air so as to dissipate a portion of heat produced in the combustion chamber. It is preferable to burn fuel in a region where an excess air ratio is large.

In the burner having the above described arrangement, even if flames move away from the flame ports upon an increase of the fuel or the excess air ratio, combustion is performed through collision of the counterflow flames with each other at a central portion of the combustion chamber or through collision of the flames with the opposed walls of the combustion chamber, and accordingly the flames are not readily blown off.

In conventional devices related to high-load combustion, turbulent combustion leading to forced agitation of the fuel-air mixture has been employed. However, in this known method, since the noise produced by combustion is large, it has been necessary to insulate the device or otherwise damp the noise.

In the present invention, since the fuel-air mixture at the flame ports disposed adjacent to the outlets of the combustion chamber is preheated by high-temperature exhaust gas generated from the flames produced at the flame ports spaced away from the outlets of the combustion chamber, the flames produced at the flame ports adjacent to the outlets of the combustion chamber are remarkably stable.

Furthermore, in the present invention, the amount of NOx discharged is reduced through dispersion of the flames, absorption of heat of the flames by the use of the walls of the combustion chamber and fins, and heat dissipation from the fuel supply passages. Especially when the amount of combustion or the excess air ratio is small, the flames are formed close to the flame ports so as to heat the flame ports, so that the amount of NOx produced is reduced through heat dissipation from the flame ports.

BRIEF DESCRIPTION OF THE DRAWINGS

These objects and features of the present invention will become apparent from the following description taken in conjunction with the preferred embodiments thereof with reference to the accompanying drawings, in which.

Figure 7:
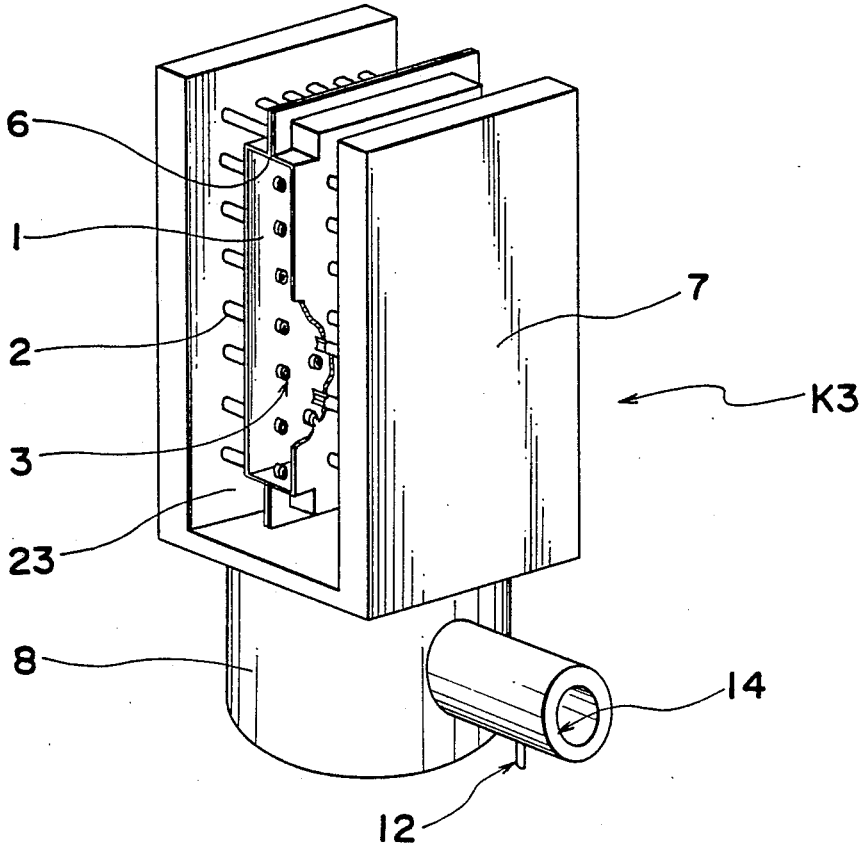
Figure 8:
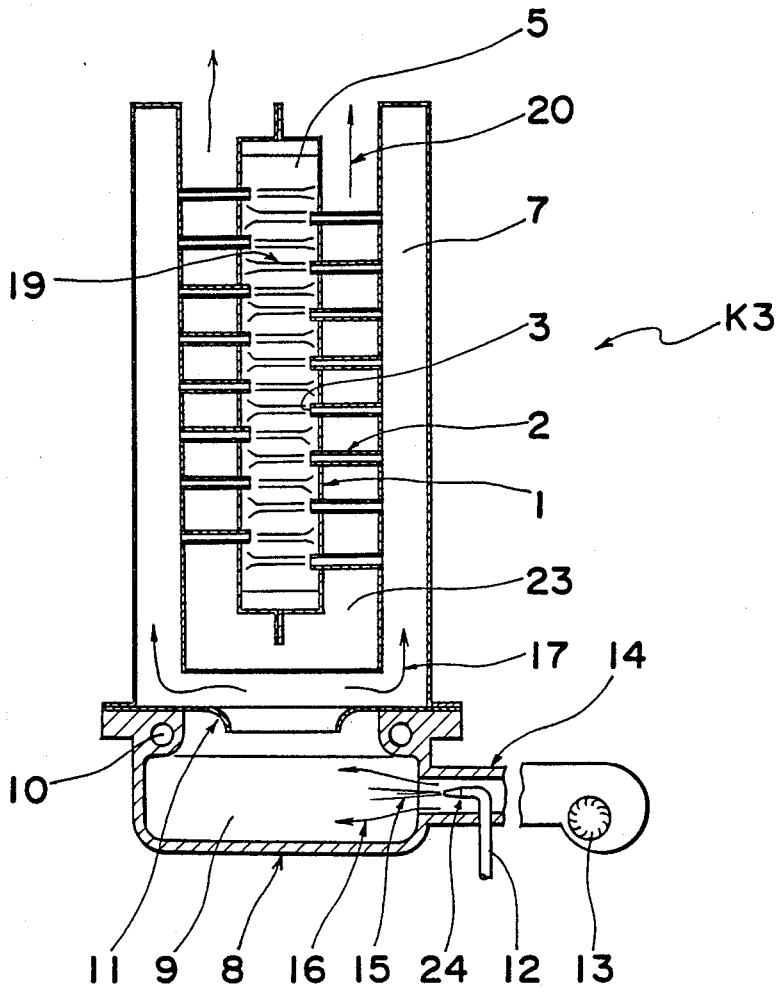
Figure 9:
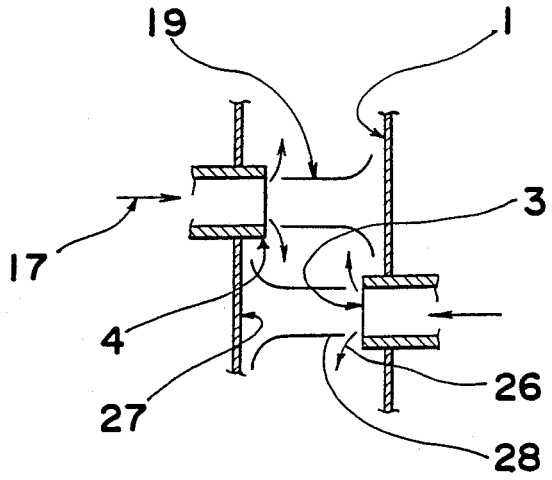
Figure 10:
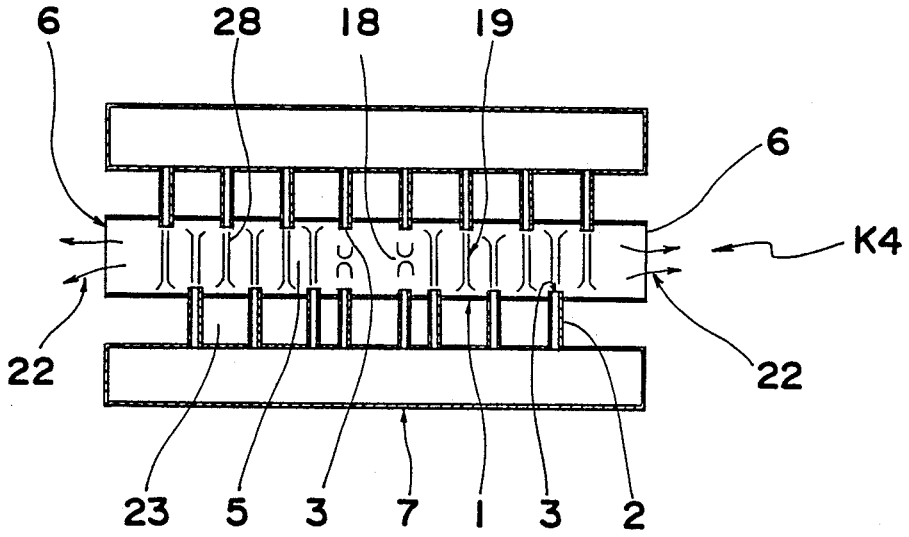

FI. 7 is a partially cutaway perspective view of a burner according to a third embodiment of the present invention;

FIG. 8 is a longitudinal sectional view of the burner of FIG. 7;

FIG. 9 is an explanatory view illustrating counterflow premixed flames produced in the burner of FIG. 7; and FIG. 10 is a transverse sectional view of a burner according to a fourth embodiment of the present invention.

Before the description of the present invention proceeds, it is to be noted that like parts are designated by like reference numerals throughout several views of the accompanying drawings.

DETAILED DESCRIPTION OF THE PREFERRED EMBODIMENTS

Figure 1:
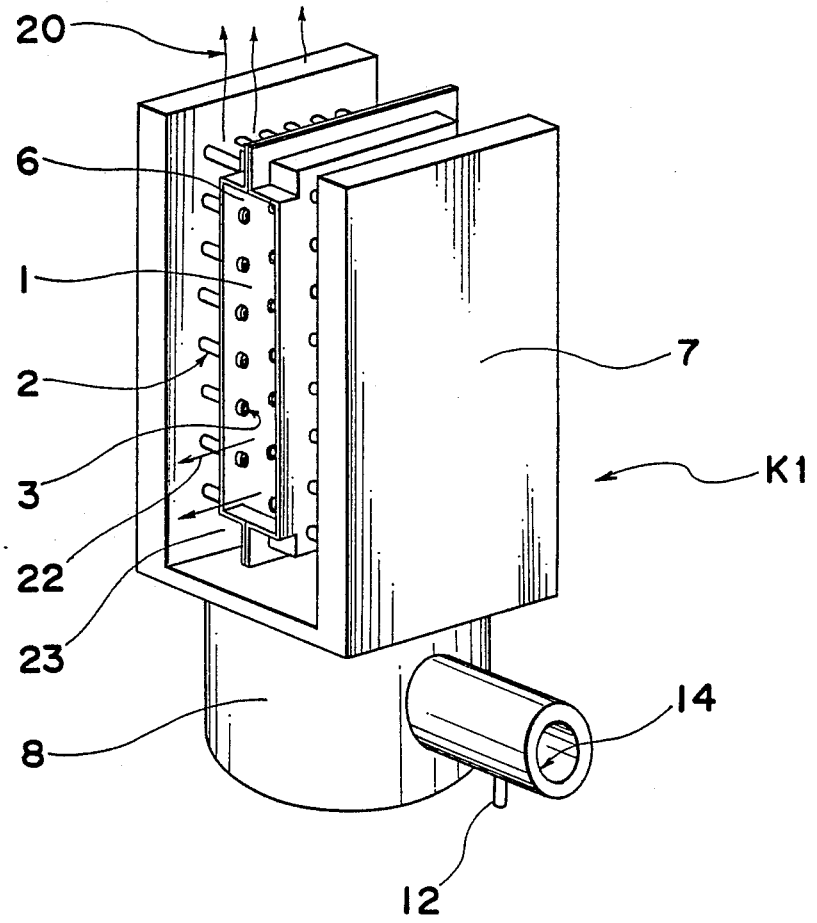
FIG. 1 is a perspective view of a burner according to a first embodiment of the present invention.
Figure 2:
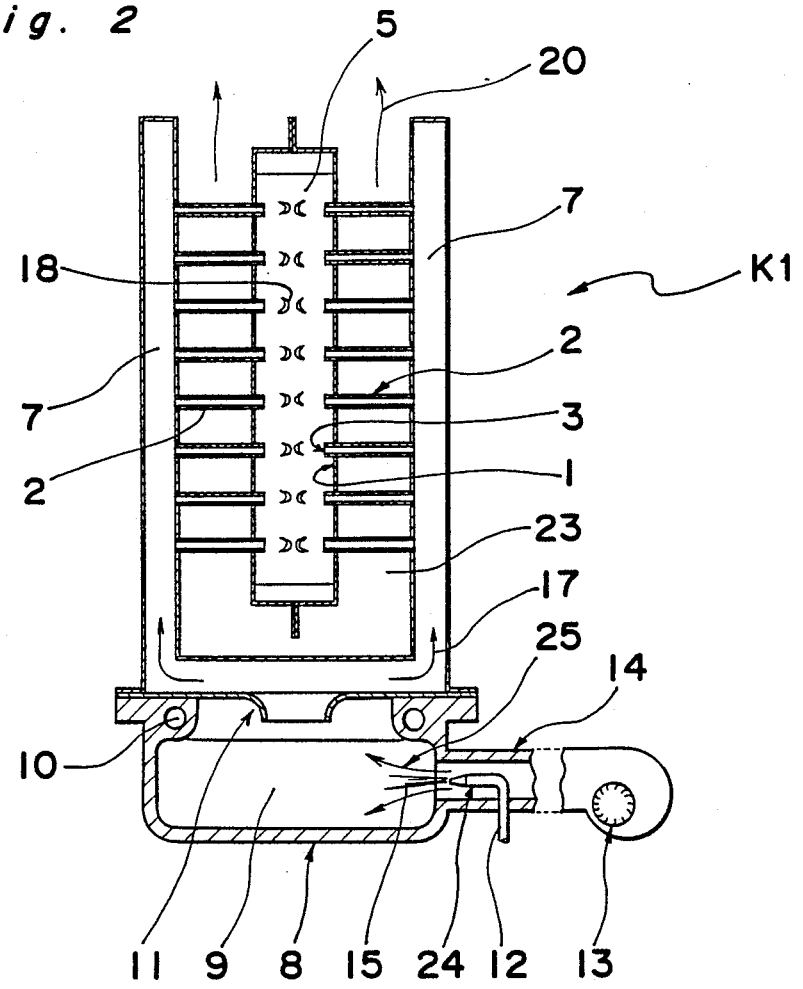
FIG. 2 is a longitudinal sectional view of the burner of FIG. 1.

Referring now to the drawings, there is shown in FIGS. 1 and 2, a burner K1 according to a first embodiment of the present invention. In the burner K1, fuel 15 is passed through a feed tube 12 so as to be delivered from a nozzle 24 to a vaporizer 8, while combustion air 25 is drawn by a blower 13 into the vaporizer 8 through a blast tube 14. The fuel 15 and the combustion air 25 are heated by a heater 10 embedded in the vaporizer 8. When the fuel 15 is liquid fuel, the fuel 15 and the combustion air 25 are heated to temperatures between 200° and 300° C. by the heater 10. Then, the fuel 15 and the combustion air 25 thus heated are mixed to provide a fuel-air mixture 17 in a mixing chamber 9. The fuel-air mixture 17 is drawn through a pair of headers 7 into a number of fuel supply passages 2 provided on the headers 7 so as to be introduced into a combustion chamber 5 from a flame port 3 located at a distal end of each of the fuel supply passages 2. The combustion chamber 5 is formed by a casing having a pair of parallel walls 1 each provided with a plurality of the flame ports 3. A portion of the casing is open so as to define an outlet 6 for combustion gas. Each of the fuel supply passages 2 has an elongated portion extending from a respective one of opposite walls 1 of the combustion chamber 5.

When the fuel-air mixture 17 is ignited, flames 18 are produced. When gaseous fuel is used instead of liquid fuel, it is possible to perform combustion of the gaseous fuel without providing the vaporizer 8. The flame ports 3 confront each other across the combustion chamber 5. A number of the flame ports 3 are arranged in a matrix on the walls 1 of the combustion chamber 5 so as to be spaced a predetermined distance from each other in each of the rows and columns of the matrix. A number of the fuel supply passages 2 having the flame ports 3, respectively, extend outside the walls 1 of the combustion chamber 5 so as to extend between each of the walls 1 of the combustion chamber 5 and each of the headers 7 such that a cooling passage 23 for passing cooling air 20 therethrough is defined between each of the walls 1 of the combustion chamber 5 and each of the headers 7.

When the fuel-air mixture 17 is ignited in the burner K1 of the above described arrangement, a number of the flames 18 are produced in the combustion chamber 5 but are spaced apart. Therefore, heat radiation from the flames 18 is enhanced and thus, the temeratures of the flames 18 drop. Furthermore, a portion of heat produced by the flames 18 heats the walls 1 of the combustion chamber 5 and the fuel supply passages 2. Because of the dissipation of heat from surfaces of the walls 1 of the combustion chamber 5 and the fuel supply passages 2, the temperatures of the flames 18 in the combustion chamber 5 are reduced such that amount of nitrogen oxides (NOx) contained in exhaust gas 22 is decreased. The cooling passages 23 are defined outside the walls 1 of the combustion chamber 5, which are heated by the flames 18. The cooling passages 23 cool the walls 1 of the combustion chamber 5 so as to lower the temperature of the walls 1 of the combustion chamber 5, thereby resulting in a drop in temperature of the flames 18.

Meanwhile, heat supplied from the flames 18 to the flame ports 3 is transferred to the fuel supply passages 2 through heat conduction so as to heat the fuel-air mixture 17. However, since the fuel supply passages 2 are arranged in the cooling passages 23, the cooling air 20 cools the fuel supply passages 2 so as to limit a rise in temperature of the fuel supply passages 2. As a result, since the fuel-air mixture 17 passing through the fuel supply passages 2 is not heated, it is possible to maintain the flames 18 at a low temperature.

Since the walls 1 of the combustion chamber 5 and the fuel supply passages 2 are made of heat-resistant metallic material such as stainless steel and thus, can be used at high temperatures, heat dissipation from the walls 1 of the combustion chamber 5 can be increased.

Figure 3:
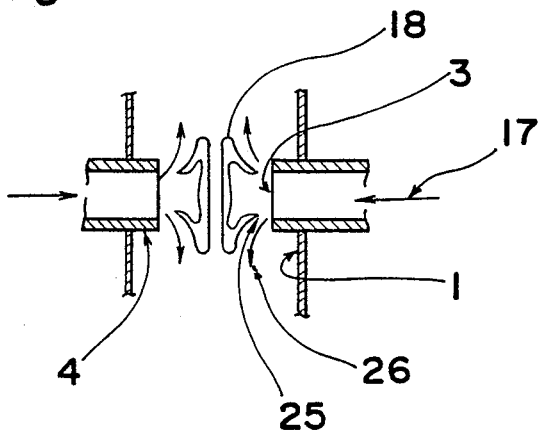
FIG. 3 is a view explanatory diagram illustrating counterflow premixed flames produced in the burner of FIG. 1.

The present invention is characterized by the formation of the counterflow premixed flames 18. The counterflow premixed flames 18 are described in detail with reference to FIG. 3 showing one pattern of the counterflow premixed flames 18. In FIG. 3, the counterflow premixed flames 18 are formed so as to be spaced away from the flame ports 3. If character V denotes a flow velocity of the fuel-air mixture 17 at the outlets of the flame ports 3 and character S denotes a burning velocity, when the flames 18 do not confront each other, the flames 18 may be blown off if $V > S$, thereby resulting in unstable combustion. However, if the opposite flame ports 3 confront each other, two flames 18 formed at the opposite flame ports 3 collide, at a central portion of the combustion chamber 5, so that a stagnation point is formed and thus, the flames 18 are not readily blown off. In the pattern of the flames 18 shown in FIG. 3, unburnt gas 26 is discharged from a clearance between an end portion 25 of each of the flames 18 and each of the flame ports 3. Since a number of the flame ports 3 are arranged and are enclosed by a casing having parallel walls 1 forming the combustion chamber 5, the unburnt gas 26 is oxidized by the neighboring flames 18. Furthermore, a number of the flame ports 3 are arranged adjacent outlets 6 of the combustion chamber 5 and are spaced apart in a direction extending toward the outlets 6. Hence, even if a portion of the unburnt gas 26 is not oxidized by the neighboring flames 18, the portion of the unburnt gas 26 is completely oxidized, while flowing from an upstream side of the flame ports 3 of the combustion chamber 5 to a downstream side, by the combustion gas having higher temperature sequentially. Since the flames 18 produced at the flame ports 3 of the combustion chamber 5 disposed at the upstream side (remote from the outlets 6) of the combustion chamber 5 supply the high-temperature combustion gas to the flames 18 produced at the downstream side (adjacent the outlets 6) of the combustion chamber 5, the flames 18 produced at the flame ports 3 of the combustion chamber 5 at the downstream side are more stabilized than the flames 18 of the flame ports 3 of the combustion chamber disposed at the upstream side. On the other hand, if $V < S$, the flames 18 are inclined to enter the flame ports 3 but the fuel supply passages 2 are cooled by the cooling air 20. Therefore, the flames 18 do not enter the fuel supply passages 2 and thus, backfire does not take place.

Meanwhile, when fuel having a slow combustion rate is used, it is desirable that the flame ports 3 project into the combustion chamber 5. If the projections 4 are provided on the flame ports 3, the projections 4 of the flame ports 3 are heated to high temperatures and thus, the fuel-air mixture to be discharged therefrom is preheated so as to be readily burnt.

Each of the fuel supply passages 2 has an elongated tubular shape. If character L denotes a length of each of the fuel supply passages 2 and character D denotes a diameter of each of the fuel supply passages 2, the fuel-air mixture 17 assumes of Poiseuille's flow at an ordinary flow velocity of the fuel-air mixture 17 if (L/D) is large. In this state, since the end portion 25 of each of the flames 18 becomes closer to each of the flame ports 3, it is possible to restrict discharge of the unburnt gas 26. In this respect, the present inventors have found that a marked effect of restricting discharge of the unburnt If the burner is arranged so that combustion is performed in the combustion chamber 5 in which a plurality of such fuel supply passages 2 are arranged in a matrix so as to confront each other coaxially, the burner can be used for high-load combustion. It is well known that if the flame is divided into small portions, the flame effects high-load combustion. In addition, in this burner, the flames collide with each other at the central portion of the combustion chamber 5 in response to an increased flow rate of the fuel-air mixture so as to form the stagnation points. At this portion of the stagnation points, the temperature is high due to the small thermal loss thereat, thereby resulting in the stabilization of the flames. Meanwhile, since the combustion rate is also increased, high-load combustion can be effected. Since the fuel supply passages 2 are cooled by the cooling passages 23, backfire does not take place. Meanwhile, since surfaces of the flames 18 are formed so as to be close to the flame ports 3, unburnt gas discharged outwardly from outer surfaces of the flames 18 are not produced.

Figure 4:
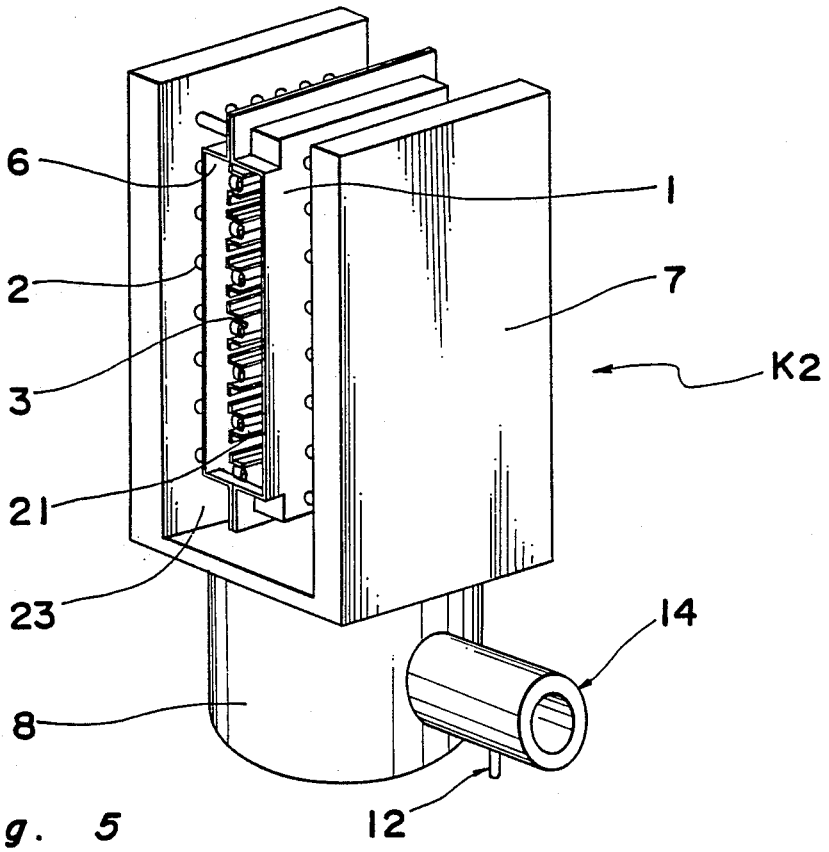
FIG. 4 is a perspective view of a burner according to a second embodiment of the present invention.
Figure 5:
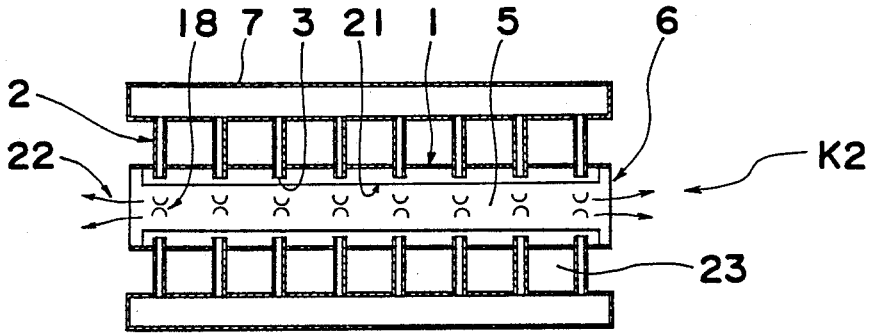
FIG. 5 is a transverse sectional view of the burner of FIG. 4.

Referring to FIGS. 4 and 5, there is shown a burner K2 according to a second embodiment of the present invention. In the burner K2, in order to lower temperature of the flames 18, heat produced by the flames 18 is dissipated to the walls 1 of the combustion chamber 5 and the fuel supply passages 2 such that amount of NOx produced is reduced. In the burner K2, a number of heat absorbing fins 21 are provided on opposite inner faces of the walls 1 of the combustion chamber 5 so as to increase a heat absorbing area such that heat dissipation is further promoted. Heat dissipation is most effective when the heat absorbing side and the heat dissipating side have identical thermal performances. Thus, if the heat absorbing area inside the combustion chamber 5 is larger than the heat dissipating area, heat absorbing fins 21 can then be provided on the heat dissipating side.

Figure 6A:
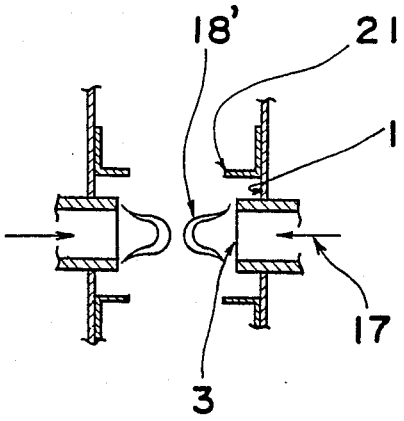
FIGS. 6A and 6B are explanatory views illustrating of counterflow premixed flames produced in the burner of FIG. 4.
Figure 6B:
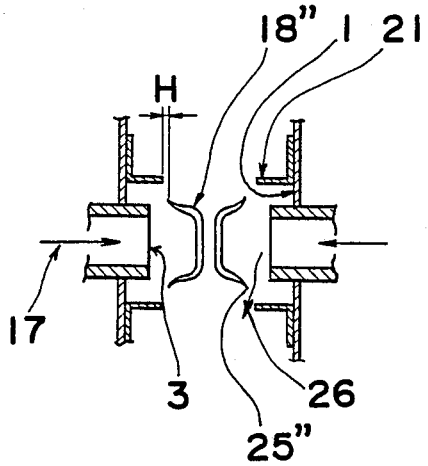

FIGS. 6A and 6B show patterns of the flames produced in the burner K2 having the heat absorbing fins 21 provided in the combustion chamber 5. FIG. 6A shows flames 18' adhering to the flame ports 3. In FIG. 6A, the burner K2 is approximately in a state of V=S. At this time, heat dissipation of the flames 18' occurs mainly through the flame ports 3. As the flow velocity V of the fuel-air mixture 17 at the outlets of the flame ports 3 is gradually increased, flames 18" move away from the flame ports 3 as shown in FIG. 6B. In this case, the unburnt gas 26 flows from clearances between the flame ports 3 and end portions 25" of the flames 18". However, since the heat absorbing fins 21 extend past the flame ports 3, the effective clearances between the end portions 25" of the flames 18" and the fins 21 are reduced. Therefore, discharge of the unburnt gas 26 is restricted and the end portions 25" of the lifted flames 18" are opened and thus, come close to the heat absorbing fins 21 so as to transfer heat to the heat absorbing fins 21. Accordingly, since the heat absorbing fins 21 absorb not only heat of high-temperature gas in the combustion chamber 5 but heat from the flames 18", temperature of the flames 18" drops and thus, the amount of NOx produced is reduced.

Referring further to FIGS. 7 and 8, there is shown a burner K3 according to a third embodiment of the present invention. In the burner K3, a number of the flame ports 3 are provided at predetermined intervals on the opposite walls 1 of the combustion chamber 5 such that axes of the flame ports 3 provided on one of the walls 1 do not coincide with those of the flame ports 3 provided on the other one of the walls 1. The fuel supply passge 2 are disposed outside the walls 1 of the combustion chamber 5. The burner K3 is characterized in that flames 19 are brought into collision with the opposed walls 1 of the combustion chamber 5. The flames 19 are described in detail with reference to FIG. 9 illustrating a pattern of the flames 19 in collision with the walls 1 of the combustion chamber 5. The fuel-air mixture 17 is injected from the flame ports 3 so as to produce the flames 19. The flames 19 are brought into collison with the walls 1 of the combustion chamber 5 so as to form flame collison portions 27 on the walls 1, respectively, where the flames 19 are brought into collision with the walls. Since the flames 19 having collided with the walls 1 of the combustion chamber 5 spread along the walls 1 such that heat of the flames 19 are transferred to the walls 1, the temperatures of the flames 19 drop and thus, the amount of NOx produced is reduced.

Meanwhile, high-temperature gas produced by the flames 19 having come into collided with the walls 1 of the combustion chamber 5 flows along the opposite walls 1 of the combustion chamber 5. Thus, the high-temperature gas not only heats the neighboring projections 4 of the flame ports 3 but also supplies heat to base portions 28 of the flames 19 released from the corresponding flame ports 3 so as to stabilize the flames 19. Furthermore, when the flow velocity V of the fuel-air mixture 17 at the outlets of the flame ports 3 is increased during an increase in the amount of combustion, the unburnt gas 26 is partially discharged from clearances between the base portions 28 of the flames 19 and the flame ports 3 but is sequentially oxidized by the high-temperature gas while flowing towards the outlets of the combustion chamber 5.

Referring finally to FIG. 10, there is shown a burner K4 according to a fourth embodiment of the present invention. In the burner K4, some of the opposite flame ports 3 are aligned with each other and others of the opposite flame ports 3 are out of alignment with each other in combination. When the excess air ratio is quite high, the flames 18, which are aligned with each other, move away from the flame ports 3 so as to collide with the counterflow flmes 18 at the central portion of the combustion chamber 5. Meanwhile, since heat of the flames 19 coming into collision with the walls 1 of the combustion chamber 5 is directly absorbed by the walls 1 of the combustion chamber 5, heat dissipation of the flames 19 is larger than that of the flames 18, thereby resulting in deterioration of stability of the flames 19. On the other hand, when the amount of combustion is larger or the excess air ratio is low, the heat generated is large or the temperatures of the flames becomes higher. However, in this case, since the quantity of heat absorbed in the combustion chamber 5 is increased, the temperatures of the flames drop and thus, the amount of NOx generated is reduced.

Accordingly, in the burner K4, at an upstream side of the combustion chamber 5, namely, at a location of the combustion chamber 5 spaced away from the outlets 6 of the combustion chamber 5, the counterflow premixed flames 18 are produced. Meanwhile, at a downstream side of the combustion chamber 5, namely at locations of the combustion chamber 5 adjacent to the outlets 6 of the combustion chamber 5, the flames 19 coming into collision with the walls 1 of the combustion chamber 5 are produced. As a result, in the burner K4, stability of the flames is excellent and the amount of NOx produced is small. Meanwhile, the exhaust gas 22 generated from the counterflow premixed flames 18 heats the inside of the combustion chamber 5 at high temperatures so as to raise the temperature of the base portions 28 of the flames 19 colliding with the walls 1 of the combustion chamber 5 at the downstream side and the projections 4 of the flame ports 3 such that stability of the flames is enhanced. The above-described high-temperature gas does not cause a backfire. Namely, since the cooling passages 23 are formed by the walls 1 of the combustion chamber 5 and the header 7, the fuel supply passages 2 disposed in the cooling passages 23 outside the walls 1 of the combustion chamber 5 dissipate heat to the cooling air 20 and thus, a rise in temperature of the fuel-air mixture is prevented.

As is clear from the foregoing description, the burner of the present invention achieves two effects which are enlarging the stable flame region and reducing the amount of produced produced. It is well known that a drop of in the temperatures the flames is most effective for reducing the amount of NOx produced. However, the drop in temperatures of the flames leads to deterioration of stability of the flames. Meanwhile, the amount of NOx produced can be reduced also by raising the primary air ratio. However, a rise in the primary air ratio also deteriorates stability of the flames. In totally aerated combustion, stable combustion is performed at a location where the flow velocity V of the fuel-air mixture at the outlets of the flame ports coincides with a burning velocity of the flames.

In the present invention, a number of the confronting flames are produced in the combustion chamber and a plurality of the flame ports are disposed adjacent the outlets of the combustion chamber in directions extending toward the outlets. When the opposite flame ports are in alignment with each other, counterflow premixed flames are produced and stagnation points are formed at the central portion of the combustion chamber, thus bringing about the following effects (1) and (2).

(1) Stability of the flames is excellent especially when the primary air ratio is high.

(2) The amount of NOx produced is remarkably reduced.

On the other hand, when the opposite flame ports are out of alignment with each other, the stagnation points are disposed at the walls of the combustion chamber and the high-temperature gas flows along the walls of the combustion chamber, thereby achieving the following effects (1) and (2).

(1) The amount of NOx produced is remarkably reduced when the primary air ratio is low.

(2) Stability of the flames is excellent especially when the amount of combustion is large.

Furthermore, if the above-described two arrangements are combined with each other, intermediate affects with respect to those of the two arrangements can be achieved.

In the present invention, since the counterflow premixed flames are produced, the flow velocity of the fuel-air mixture at the outlets of the flame ports is high. Furthermore, in the present invention, a number of the flame ports are provided. Thus, even if a small amount of unburnt gas is produced, the unburnt gas is oxidized by the neighboring flames, thereby resulting in an improvement in the characteristics of the exhaust gas.

Meanwhile, in the present invention, since the fuel supply passages are long, flow of the fuel-air mixture is rectified, so that the fuel-air mixture assumes Poiseuille's flow in a laminar flow region, thereby resulting in a stable flame pattern. Furthermore, since the fuel supply passges are disposed in the cooling passage, backfire does not take place.

Moreover, in the present invention, since a plurality of the flame ports are provided adjacent the outlets of the combustion chamber in directions extending toward the outlets and the projections of the flame ports protrude into the combustion chamber, the fuel-air mixture at the flame ports disposed adjacent to the outlets of the combustion chamber is preheated by the flames at the flame ports disposed at the upstream side of the combustion chamber, so that temperature of the projections of the flame ports disposed adjacent to the outlets of the combustion chamber rises, and the flames at the flame ports disposed adjacent to the outlets of the combustion chamber become stable.

In the present invention, in order to reduce the amount of Nox produced, the cooling passage is defined by the walls of the combustion chamber and the fuel supply passages so as to facilitate heat dissipation in a manner in which the temperature in the combustion chamber is lowered for reducing the amount of NOx produced. Moreover, to this end, the heat absorbing fins are produced in the combustion chamber so as to further lower the temperature in the combustion chamber such that the amount of NOx produced is further reduced.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as being included therein.

What is claimed is:

1. A burner comprising:

a casing having a pair of parallel walls defining a combustion space therebetween, and an exhaust outlet through which combustion gas passes in an exhaust flow direction from the casing;

a first and a second set of pipes, each of the pipes of said first set of pipes fixed to and extending perpendicularly outwardly of said casing from one of said parallel walls, and each of the pipes of said second set of pipes fixed to and extending perpendicularly outwardly of said casing from the other of said parallel walls, each of said pipes having a first end defining a flame port open to the combustion space defined between said pair of parallel walls, and a second end, the flame port of each pipe of said first set of pipes aligned with and confronting the flame port of a respective pipe of said second set of pipes across the combustion space, the pipes of said first set of pipes arranged in a plurality of stages on said one of said parallel walls, and the pipes of said second set of pipes arranged in a plurality of stages on said other of said parallel walls, each of said stages being defined by respective pipes of said sets of pipes spaced apart from one another in a direction parallel to the exhaust flow direction in which combustion gas passes from the casing out said exhaust outlet;

a header in communication with the second end of each of said pipes for supplying a fuel-air mixture to said sets of pipes, said header spaced from said parallel walls with a cooling space defined between said header and said parallel walls; and a fuel-air mixture passage means in communication with said header for supplying sid header with a mixture of fuel and air.

2. A burner as claimed in claim 1, wherein the first end of each of said pipes projects into the combustion space.

3. A burner as claimed in claim 1, and further comprising a plurality of fins extending within the combustion space and perpendicularly to said parallel walls adjacent said flame ports, each of said fins projecting further toward the center of the combustion space from a respective ones of said parallel walls than the flame ports of said pipes adjacent said fins.

4. A burner as claimed in claim 1, wherein the flame port of each of the pipes of said first set of pipes is spaced a distance from the confronting flame port of the respective pipe of said second set of pipes that is sufficient to prevent flames issuing from the confronting flame ports from moving from said flame ports a distance at which the flames would become extinguished.

5. A burner comprising:

a casing having a pair of parallel walls defining a combustion space therebetween, and an exhaust outlet through which combustion gas passes in an exhaust flow direction from the casing;

a first and a second set of pipes, each of the pipes of said first set fixed to and extending perpendicularly outwardly of said casing from one of said parallel walls, and each of the pipes of said second set of pipes fixed to and extending perpendicularly outwardly of said casing from the other of said parallel walls, each of said pipes having a first end defining a flame port open to the combustion space defined between said pair of parallel walls, and a second end, the flame ports of some of the pipes of said first set of pipes respectively aligned with and confronting the flame ports of some of the pipes of said second set of pipes across the combustion space, and the flame ports of the remainder of the pipes of said first set of pipes offset with respect to the flame ports of the remainder of the pipes of said second set of pipes, said flame ports of the remainder of the pipes of said sets of pipes being disposed closer to the exhaust outlet of said casing than said flame ports of said some of the pipes of said sets of pipes, the pipes of said first set of pipes arranged in a plurality of stages on said one of said parallel walls, and the pipes of said second sets of pipes arranged in a plurality of stages on said other of said parallel walls, each of said stages being defined by respective pipes of said sets of pipes spaced apart from one another in a direction parallel to the exhaust flow direction in which combustion gas passes from the casing out said exhaust outlet;

a header in communication with the second end of each of said pipes for supplying a fuel-air mixture to said sets of pipe, said header spaced from said parallel walls with a cooling space defined between said header and said parallel walls; and a fuel-air mixture passage means in communication with said header for supplying said header with a mixture of fuel and air.

* * * * *